US008602530B2

(12) United States Patent
Mizukami et al.

(10) Patent No.: US 8,602,530 B2
(45) Date of Patent: Dec. 10, 2013

(54) INK-JET HEAD AND INK-JET RECORDING APPARATUS

(75) Inventors: Satoshi Mizukami, Kanagawa (JP); Masaki Kato, Tokyo (JP); Takahiko Kuroda, Hyogo (JP); Yoshikazu Akiyama, Kanagawa (JP); Kanshi Abe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/396,830

(22) Filed: Feb. 15, 2012

(65) Prior Publication Data

US 2012/0212545 A1 Aug. 23, 2012

(30) Foreign Application Priority Data

Feb. 22, 2011 (JP) ..... 2011-036348

(51) Int. Cl.
*B41J 2/14* (2006.01)

(52) U.S. Cl.
USPC ..... 347/50

(58) Field of Classification Search
USPC ..... 347/50
See application file for complete search history.

(56) References Cited

U.S. PATENT DOCUMENTS

| | | | | |
|---|---|---|---|---|
| 5,918,354 | A * | 7/1999 | Ikegami et al. | 29/25.35 |
| 5,923,231 | A * | 7/1999 | Ohkubo et al. | 333/193 |
| 6,315,400 | B1 * | 11/2001 | Sakai et al. | 347/70 |
| 7,559,631 | B2 * | 7/2009 | Shimada et al. | 347/64 |
| 2011/0090289 | A1 | 4/2011 | Mizukami | |

FOREIGN PATENT DOCUMENTS

| | | |
|---|---|---|
| JP | 4371209 | 9/2009 |
| JP | 2010-42683 | 2/2010 |

* cited by examiner

*Primary Examiner* — Matthew Luu
*Assistant Examiner* — Michael Konczal
(74) *Attorney, Agent, or Firm* — Cooper & Dunham LLP

(57) ABSTRACT

An ink-jet head includes a nozzle plate having nozzles, a vibrating plate on the nozzle plate, liquid chambers formed of spaces partitioned by division walls, a piezoelectric element having a common electrode, a piezoelectric body and an individual electrode layered in this order on a surface of the vibrating plate, a first insulator film having a first opening and a second insulator film having a second opening layered in this order on the first surface, a first wire drawn from the individual electrode via the first opening and the second opening, a third insulator film having a third opening on the first wire; and a second wire drawn via the third opening, where the third insulator film is formed in a first region of the second insulator film and is not formed in a second region excluding a region including the first wire formed above the liquid chamber.

7 Claims, 4 Drawing Sheets

INK-JET HEAD AND INK-JET RECORDING APPARATUS

BACKGROUND OF THE INVENTION

1. Field of the Invention

The disclosures discussed herein generally relate to an ink-jet head and an ink-jet recording apparatus.

2. Description of the Related Art

The applied micro-electromechanical system (MEMS) technology is known in the art as a technology to densify the ink-jet head (a drop-wise ink-jet head) utilizing a piezoelectric element. Such an ink-jet head may be formed in an actuator structure composed of a piezoelectric element, which is formed by patterning an individual electrode, a common electrode and a piezoelectric body formed on a vibrating plate.

However, the piezoelectric element generally has an electric property that deteriorates due to moisture in the atmosphere. Japanese Patent Application Publication No. 2010-42683 (hereinafter referred to as "Patent Document 1") discloses an ink-jet head having a configuration in which layers forming the piezoelectric element and a pattern region of a lead electrode for an upper electrode are covered with an insulator film formed of an inorganic amorphous material in order to overcome the deterioration of the electric property of the piezoelectric element due to the moisture in the atmosphere. In the ink-jet head disclosed in Patent Document 1, the insulator film includes a first insulator film and a second insulator film, and the piezoelectric element is covered with the first insulator film excluding a connecting portion connected to the lead electrode for the upper electrode. Further, the lead electrode of the upper electrode extends over the first insulator film, and the layers forming the piezoelectric element and the pattern region of the lead electrode for the upper electrode are covered with the second insulator film excluding a region facing a connecting portion connected to a connecting wire.

However, in the ink-jet head disclosed in Patent Document 1, the entire pattern region including the piezoelectric element is covered with the insulator film. Accordingly, the displacement of the piezoelectric element may be significantly inhibited if the piezoelectric element is covered with the thick insulator film. On the other hand, if the piezoelectric element is covered with the thin insulator film, a withstanding voltage between the lead electrode and a lower electrode may not be secured. Thus, it may be necessary to arrange the electrodes such that the lead electrode is not overlapped with the lower electrode. However, with this configuration, the ink-jet head may not be significantly reduced in size or components of the ink-jet head may not be significantly densified.

SUMMARY OF THE INVENTION

It is an object of one embodiment of the present invention to provide an ink-jet head capable of reducing its size and densifying its components while inhibiting the piezoelectric element from being deteriorated due to moisture in the atmosphere.

In one embodiment, there is provided an ink-jet head that includes a nozzle plate having a plurality of nozzles; a vibrating plate arranged on the nozzle plate; a plurality of liquid chambers formed of spaces between the vibrating plate and the nozzle plate, the spaces being partitioned by division walls; a piezoelectric element composed of a common electrode, a piezoelectric body and an individual electrode layered in this order, the piezoelectric element being formed on a first surface of the vibrating plate opposite to a second surface thereof that forms the liquid chambers; a first insulator film having a first opening and a second insulator film having a second opening, the first insulator film and the second insulator film being layered in this order on the first surface having the piezoelectric element of the vibrating plate; a first wire drawn from the individual electrode via the first opening of the first insulator film and the second opening of the second insulator film; a third insulator film having a third opening, the third insulator film being formed on the first wire; and a second wire configured to electrically couple the first wire and a driving circuit, the second wire being drawn via the third opening of the third insulator film. In the ink-jet head, the third insulator film is formed in a first region of the second insulator film and is not formed in a second region thereof, the second region excluding a region including the first wire formed above the liquid chamber, and the first region of the second insulator film includes a film thickness of 100 nm or more, and the second region of the second insulator film includes a film thickness range of 5 to 40 nm.

In another embodiment, there is provided an ink-jet recording apparatus including the ink-jet head.

Additional objects and advantages of the embodiments will be set forth in part in the description which follows, and in part will be obvious from the description, or may be learned by practice of the invention. It is to be understood that both the foregoing general description and the following detailed description are exemplary and explanatory only and are not restrictive of the invention, as claimed.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

An ink-jet head according to an embodiment includes a nozzle plate having plural nozzles and a vibrating plate arranged on the nozzle plate. The ink-jet head according to the embodiment further includes plural liquid chambers formed of spaces between the vibrating plate and the nozzle plate, which are partitioned by division walls. The ink-jet head according to the embodiment further includes a piezoelectric element composed of a common electrode, a piezoelectric body and an individual electrode layered in this order. The piezoelectric element is formed on a first surface of the vibrating plate opposite to a second surface of the vibrating plate that forms the liquid chambers.

The ink-jet head according to the embodiment further includes a first insulator film having a first opening and a second insulator film having a second opening that are layered in this order on the first surface having the piezoelectric element of the vibrating plate. The ink-jet head according to the embodiment further includes a first wire drawn from the individual electrode via the first opening of the first insulator film and the second opening of the second insulator film.

In the ink-jet head according to the embodiment, a third insulator film having a third opening is formed on the first wire, and a second wire configured to electrically couple the first wire and a driving circuit is drawn via the third opening of the third insulator film.

In the ink-jet head according to the embodiment, the second insulator film includes a first region in which the third insulator film is formed and a second region in which the third insulator film is not formed. More specifically, in the ink-jet head according to the embodiment, the second region excludes a region where the first wire is formed above the liquid chamber, and the third insulator film is not formed in the second region of the second insulator film.

In the following, preferred embodiments are described below with reference to the accompanying drawings.

Figure 1A:
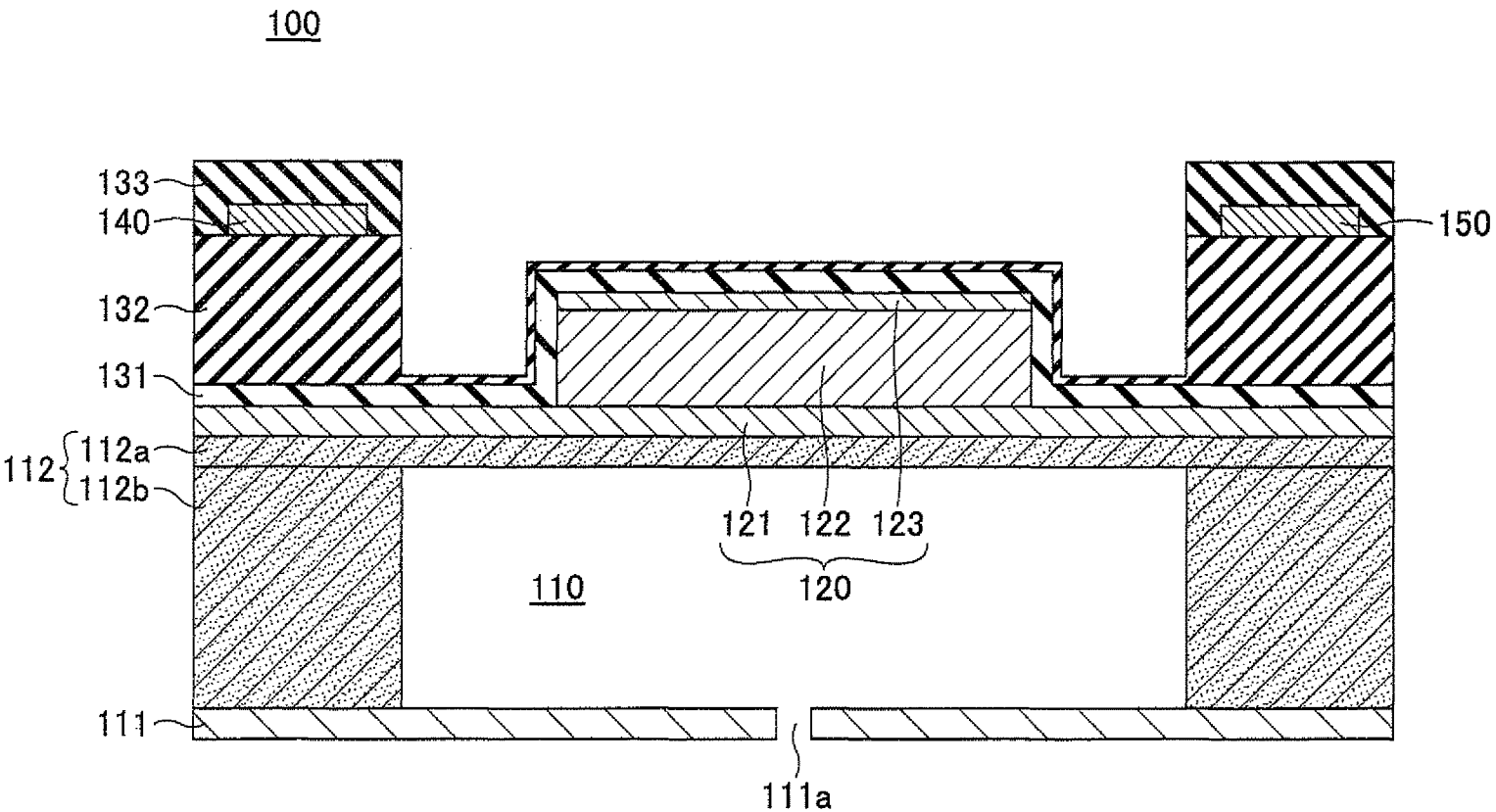
FIGS. 1A and 1B are cross-sectional views illustrating an example of an ink-jet head according to an embodiment.
Figure 1B:
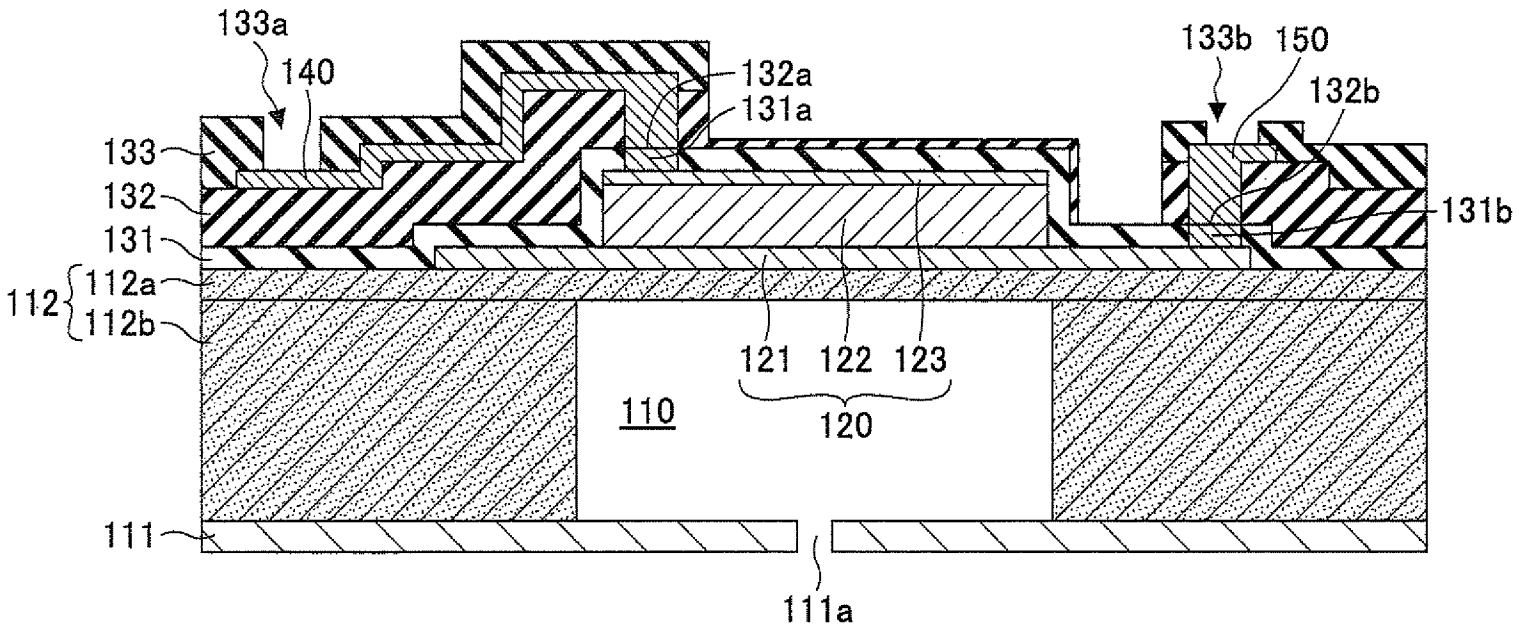

FIGS. 1A and 1B illustrate an example of the ink-jet head according to the embodiment. FIG. 1B is a cross sectional view of the ink-jet head of FIG. 1 taken along a vertical direction.

An ink-jet head 100 includes plural individual liquid chambers 110. The individual liquid chambers 110 are formed of spaces between a nozzle plate 111 having plural nozzle pores 111*a* and a vibrating plate 112*a* of a liquid chamber substrate 112, and the spaces between the nozzle plate 111 and the vibrating plate 112*a* are partitioned by division walls 112*b* of the liquid chamber substrate 112. Note that the liquid chamber substrate 112 is formed of the vibrating plate 112*a* and the division walls 112*b*. That is, the individual liquid chambers 110 are formed of the spaces between the nozzle plate 111 and the vibrating plate 112*a* that are partitioned by the division walls 112*b*.

Note that FIGS. 1A and 1B illustrate only one individual liquid chamber 110; however, the plural individual liquid chambers are aligned in a horizontal direction of FIG. 1A.

Further, a common electrode 121 is formed on the vibrating plate 112*a*, and a piezoelectric body 122 and an individual electrode 123 are layered in this order on the common electrode 121. A piezoelectric element 120 is formed of the common electrode 121, the piezoelectric body 122 and the individual electrode 123, and may be any configuration insofar as the piezoelectric element 120 includes the common electrode 121, the piezoelectric body 122 and the individual electrode 123.

[Insulator Film]

Next, details of three types of insulator films utilized in the ink-jet head according to the embodiment are described below.

On the vibrating plate 112*a* forming the piezoelectric element 120, a first insulator film 131 having an opening 131*a* corresponding to the individual electrode 123 and a second insulator film 132 having an opening 132*a* corresponding to the individual electrode 123 are layered in this order. In this configuration, an individual electrode wire 140 is drawn from the individual electrode 123 via the openings 131*a* and 132*a*.

In addition, a third insulator film 133 having a contact hole 133*a* is formed on the individual electrode wire 140. The contact hole 133*a* is formed such that a not illustrated wire configured to electrically couple the individual electrode wire 140 and a not illustrated driving circuit is drawn from the contact hole 133*a*. In this configuration, the third insulator film 133 is not formed in a region including the individual electrode wire 140 above the space (i.e., corresponding to a liquid chamber) partitioned by the division walls 112*b* in order to increase the displacement of the piezoelectric element 120.

Meanwhile, the first insulator film 131 and the second insulator film 132 further include respective openings 131*b* and 132*b*, respectively, and a common electrode wire 150 is drawn via the openings 131*b* and 132*b* from the common electrode 121 to a region including part of the common electrode 121. In addition, the third insulator film 133 further includes a contact hole 133*b*. In the third insulator film 133, a not illustrated wire configured to electrically couple the individual electrode wire 150 and the not illustrated driving circuit is drawn from the contact hole 133*b*.

The first insulator film 131 serves as a function to protect the piezoelectric element 120. More specifically, the first insulator film 131 serves as the function to prevent the piezoelectric element 120 from being damaged during a deposition process and an etching process.

A material for the first insulator film 131 may not particularly be specified. Any materials through which the moisture in the atmosphere is hard to pass may be used, a preferable example of which includes a dense inorganic material such as an oxide, a nitride and a carbide. If an organic material is used as the material for the first insulator film 131, the first insulator film 131 may need to have a sufficient film thickness for exhibiting sufficient protective performance. However, if the first insulator film 131 has an increased film thickness, the vibration displacement of the vibrating plate may be drastically inhibited. As a result, discharging performance of the ink-jet head may be degraded. In addition, it is preferable that the material for the first insulator film 131 have high adhesiveness with base materials of the first insulator film 131 including an electrode material, a piezoelectric body material and a vibrating plate material.

Preferable examples of the material for the first insulator film 131 may include an oxide such as $Al_2O_3$, $ZrO_2$, $Y_2O_3$, $Ta_2O_3$ or $TiO_2$, a nitride such as SiN and a carbide such as SiC, or a combination of two or more of these materials.

It is preferable that the film thickness range of the first insulator film 131 be in a range of 20 to 100 nm. If the film thickness of the first insulator film 131 exceeds 100 nm, the displacement of the vibrating plate 112*a* may be inhibited. If, on the other hand, the film thickness of the first insulator film 131 is thinner than 20 nm, the first insulator film 131 may not sufficiently serve as a protective layer for the piezoelectric element 120. As a result, the piezoelectric element 120 may be deteriorated.

A depositing process of the first insulator film 131 is not particularly specified; however, a preferable process includes a vapor-deposition process and an atomic-layer deposition (ALD) process, with the ALD process being highly preferable in view of a wide range of the material selection.

The second insulator film 132 serves as a function to protect the piezoelectric element 120 similar to the first insulator film 131. The second insulator film 132 further serves as a function of an interlayer protective film to prevent a short circuit from being formed between the individual electrode wire 140 and the common electrode 121. Accordingly, the individual electrode 123 and the individual electrode wire 140 may be arranged more flexibly, which enables the components of the ink-jet head 100 to be densified while reducing the size of the ink-jet head 100. Further, the second insulator film 132 further serves as a mask layer when the third insulator film 133 is being etched. The second insulator film 132 has a first region in which the third insulator film 133 is formed and a second region in which the third insulator film 133 is not formed. Note that in the second insulator film 132, the first region includes a film thickness greater than that of the second region. With this configuration, the displacement inhibition of the piezoelectric element 120 may be controlled.

A material for the second insulator film 132 may not be particularly specified; however, preferable examples of the second insulator film 132 may include an oxide such as $ZrO_2$, $Y_2O_3$, $Ta_2O_3$, $TiO_2$ and SiO, or a combination of two or more of these materials.

A preferable example of the depositing process of the second insulator film 132 includes the vapor-deposition process, the ALD process and a plasma CVD (p-CVD) process, with the ALD process being highly preferable in view of a wide range of the material selection. The second insulator film 132 formed by the ALD process appears to exhibit high density and a high withstanding voltage compared to that formed by the p-CVD process.

If the second insulator film 132 is formed by the ALD process, it is preferable that the second insulator film 132 have a film thickness of 100 nm or more, or it is highly preferable that the second insulator film 132 have a film thickness of 300 nm or more. Further, if the second insulator film 132 is formed by the p-CVD process, it is preferable that the second insulator film 132 have a film thickness of 100 nm or more, it is more preferable that the second insulator film 132 have a film thickness of 200 nm or more, and it is highly preferable that the second insulator film 132 have a film thickness of 500 nm or more. If the film thickness of the second insulator film 132 is less than the aforementioned film thickness ranges, the second insulator film 132 may not sufficiently exhibit moisture permeability resistance for blocking the moisture in the atmosphere. Further, a short circuit may be formed between the individual electrode wire 140 and the common electrode 121.

The second region of the second insulator film 132 where the third insulator film 133 is not formed may preferably include a film thickness range of 5 to 40 nm. If the film thickness in the second region of the second insulator film 132 where the third insulator film 133 is not formed is greater than 40 nm, the displacement of the vibrating plate 112*a* may be inhibited. If, on the other hand, the film thickness in the second region of the second insulator film 132 where the third insulator film 133 is not formed is less than 5 nm, the first insulator film 131 formed in the second region of the second insulator film 132 may have a risk of being accidentally etched.

The third insulator film 133 is a passivation layer applied to the individual electrode wires 140 and 150 for protection. In this configuration, the third insulator film 133 is not formed in a region of the second insulator film 132 excluding a region including the individual electrode wire 140 formed above the space (i.e., the liquid chamber) partitioned by the division walls 112*b*. With this configuration, the displacement inhibition of the piezoelectric element 120 may be controlled, and the ink-jet head 100 may exhibit excellent discharge performance.

A material for the third insulator film 133 may not be particularly specified; however, preferable examples of the third insulator film 133 may include inorganic materials such as an oxide such as $SiO_2$, a nitride such as SiN, and a carbide such as SiC, organic materials such as polyimide, acrylic acid resin and urethane resin, or a combination of two or more of these materials. Among these, the inorganic materials may be preferable in view of sufficiently exhibiting a wire protection function with a thinner film thickness.

It is preferable that the film thickness of the third insulator film 133 be 200 nm or more, and it is highly preferable that the film thickness of the third insulator film 133 be 500 nm or more. If the film thickness of the third insulator film 133 is thinner than 200 nm, the third insulator film 133 may not sufficiently serve as a protective layer for the individual electrode wires 140 and 150. As a result, the individual electrode wires 140 and 150 may be corroded, which results in disconnection of the individual electrode wires 140 and 150.

A preferable example of a depositing process of the third insulator film 133 includes a plasma CVD (p-CVD) process and a sputtering process. Further, a preferable example of an etching process of the third insulator film 133 includes a photolithography process and a dry etching process.

[Other Configuration]

[Liquid Chamber Substrate]

A material for the liquid chamber substrate 112 may not particularly be specified; however, the liquid chamber substrate 112 may generally be formed by performing the photolithography process or an anisotropic etching process on a single-crystalline silicon substrate having a plane direction (Miller index) of (1 0 0) or (1 1 1). Further, the vibrating plate 112*a* may be formed by the p-CVD process to deposit Si, $SiO_2$, $Si_3N_4$ and the like in layers.

A preferable thickness range of the liquid chamber substrate 112 may generally be 100 to 600 μm.

If lead zirconate titanate (PZT: the solid solution of lead zirconate ($PbZrO_3$) and lead titanate ($PbTiO_3$)) having a linear expansion coefficient of $8*10^{-6}$ (1/K) is utilized as the piezoelectric body, the vibrating plate 112*a* preferably has a linear expansion coefficient range of $5*10^{-6}$ to $10*10^{-6}$, and more preferably has a linear expansion coefficient range of $7*10^{-6}$ to $10*10^{-6}$. Thus, a preferable example of a material for the vibrating plate 112*a* includes an aluminum oxide, a zirconium oxide, an iridium oxide, a ruthenium oxide, a tantalum oxide, a hafnium oxide, an osmium oxide, a rhenium oxide, a rhodium oxide and a palladium oxide, or a combination of two or more of these materials.

[Vibrating Plate]

A forming process of the vibrating plate 112*a* may not particularly be specified; however, examples of the forming process of the vibrating plate 112*a* include a sputtering process and a sol-gel process.

A thickness range of the vibrating plate 112*a* may generally be 0.1 to 10 μm, and may preferably be 0.5 to 3 μm. If the thickness of the vibrating plate 112*a* is less than 0.1 μm, it may be difficult to process the vibrating plate 112*a*. If, on the other hand, the thickness of the vibrating plate 112*a* is greater than 10 μm, the vibrating plate 112*a* may have difficulty in displacement.

[Common Electrode]

A material for the vibrating plate 112*a* may not particularly be specified; however, a preferable example of the material for the vibrating plate 112*a* includes an electrically conductive metal oxide and the like. More specifically, the preferable example of the material for the vibrating plate 112*a* includes a composite oxide expressed by $ABO_3$, where A represents Sr, Ba, Ca and La, and B represents Ru, Co and Ni as major components; $SyRuO_3$, $CaRuO_3$ and the solid solution $(Sr_{1-x}Ca_x)O_3$ of $SyRuO_3$ and $CaRuO_3$; $LaNiO_3$, $SrCoO_3$ and the solid solution $(La,Sr)(Ni_{1-y},Co_y)O_3$ (y may be 1). Oxide materials other than those described above may include $IrO_2$ and $RuO_2$. Further, platinum group metals having heat resistance and high reactivity such as ruthenium (Ru), rhodium (Rh), palladium (Pd), osmium (Os) and iridium (Ir), or alloy material including the platinum (Pt) group metals may be used as the materials for the vibrating plate 112*a*. Moreover, the electrically conductive metal oxide may be layered on the aforementioned metallic layer.

If an electromechanical transducer element is applied to a liquid discharge head, Ti, $TiO_2$, TiN, Ta, $Ta_2O_5$, $Ta_3N_5$ and the like may be initially layered on the liquid chamber substrate 112 in order to improve adhesiveness between the electromechanical transducer element and the vibrating plate 112*a*.

Note that the common electrode 121 may be formed by the sputtering process or a vacuum deposition process.

[Piezoelectric Body]

A material for the piezoelectric body 122 may not particularly be specified; however, a preferable example of the material for the piezoelectric body 122 includes a composite metal oxide such as PZT. The PZT is the solid solution of lead zirconate ($PbZrO_3$) and lead titanate ($PbTiO_3$). For example, the PZT having a ratio of $PbZrO_3$ to $PbTiO_3$ of 53:47 may be used as the material for the piezoelectric body 122, which is generally represented by PZT (53/47) and expressed by the chemical formula $Pb(Zr_{0.53}, Ti_{0.47})O_3$.

Examples of the composite metal oxide other than the PZT include barium titanate and the like. In this case, barium alkoxide and titanium alkoxide compounds may be utilized as starting materials, and a barium titanate precursor solution may be prepared by dissolving the starting materials in a common solvent. These materials may be a composite metal oxide generally expressed by $ABO_3$, where A represents Pb, Ba and Sr, and B represents Ti, Zr, Sn, Ni, Zn, Mg and Nb as major components. The examples of the composite metal oxide may be specifically expressed by $Pb_{1-x}$, Ba) (Zr, Ti)$O_3$ and ($Pb_{1-x}$, Sr) (Zr, Ti)$O_3$, which may be obtained by partially replacing "Pb" of the A site with "Ba" or "Sr". This kind of replacement may be implemented by a divalent element, and the effect of the replacement may be exhibited by lowering the property deterioration due to evaporation of lead (Pb) while heating.

A forming process of the piezoelectric body 122 may not particularly be specified; however, examples of the forming process of the piezoelectric body 122 include a sputtering process and a sol-gel process. A patterning process of the piezoelectric body 122 may not particularly be specified; however, examples of the patterning process of the piezoelectric body 122 include a photolithographic etching process and the like.

If the PZT is formed by the sol-gel process, lead acetate, zirconium alkoxide and titanium alkoxide compounds are initially dissolved as starting materials in methoxyethanol to prepare a PZT precursor solution. Since the metal alkoxide compound is likely to be easily hydrolyzed with the moisture in the atmosphere, the metal alkoxide compound may include an appropriate amount of stabilizer such as acetyl acetone, acetic acid and diethanolamine.

The PZT precursor solution is applied by a solution application process such as spin-coating to an entire surface of abase substrate, and the applied PZT precursor solution is subject to various heating processes of solution drying, thermal decomposition and crystallization, thereby forming a PZT film. Since the modification from a coated film to a crystallized film involves volume shrinkage, it may be necessary to adjust the concentration of the precursor solution to form a crack-free film having a film thickness of 100 nm or less in one process. [Individual Electrode]

A material for the individual electrode 123 may not particularly be specified; however, a preferable example of the material for the individual electrode 123 includes an electrically conductive metal oxide and a layered product of the electrically conductive metal oxide and metal.

A forming process of the individual electrode 123 may not particularly be specified; however, examples of the forming process of the individual electrode 123 include a sputtering process and a sol-gel process. A patterning process of the individual electrode 123 may not particularly be specified; however, examples of the patterning process of the individual electrode 123 include a photolithographic etching process and the like.

[Wire]

A material for the individual electrode wires 140 and 150 may not particularly be specified; however, a preferable example of the material for the individual electrode wires 140 and 150 includes an Ag-alloy, Cu, Al, Au, Pt, Ir and the like.

A forming process of the individual electrode wires 140 and 150 may not particularly be specified; however, examples of the forming process of the individual electrode wires 140 and 150 include a sputtering process and a spin-coating process.

The patterning of the individual electrode wires 140 and 150 may be implemented by an ink-jet process after partially surface-modifying the third insulator film 133. For example, if the material forming the third insulator film 133 is the oxide, the third insulator film 133 is surface-modified with a silane compound. As a result, a pattern of a third electrode or a fourth electrode may be directly printed by the ink-jet process in a region having an increased surface energy of the third insulator film 133.

The patterns of the individual electrode wires 140 and 150 may be screen printed with electrically conductive paste.

Examples of a material for the electrically conductive paste include gold paste "Perfect Gold" (registered trademark) (manufactured by Vacuum Metallurgical Co., Ltd.), copper paste "Perfect Copper" (registered trademark) (manufactured by Vacuum Metallurgical Co., Ltd.), printing transparent PEDOT/PSS ink "Orgacon Paste variant 1/4" and "Paste variant 1/3" (manufactured by Nippon Agfa Gewalt), carbon electrode paste "Orgacon Carbon Paste variant 2/2" (manufactured by Nippon Agfa Gewalt) and a PEDOT/PSS solution "BAYTRON" (registered trademark) P (manufactured by Starck Vitec Co.).

A thickness range of the individual electrode wires 140 and 150 may generally be 0.1 to 20 μm, and may preferably be 0.2 to 10 μm. If the thickness of the individual electrode wires 140 and 150 is less than 0.1 μm, the resistance of the individual electrode wires 140 and 150 may be increased. If, on the other hand, the thickness of the individual electrode wires 140 and 150 is greater than 20 μm, a process time may be increased.

[Ink-Jet Recording Apparatus]

Figure 2A:
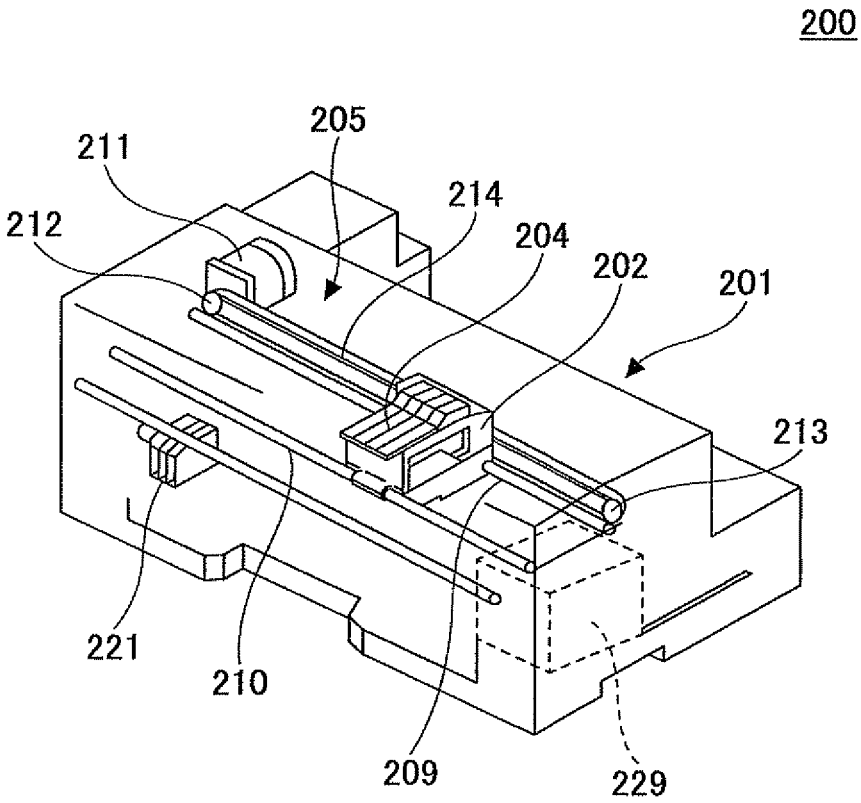
FIGS. 2A and 2B are a perspective view and a side view illustrating the example of the ink-jet head according to the embodiment.
Figure 2B:
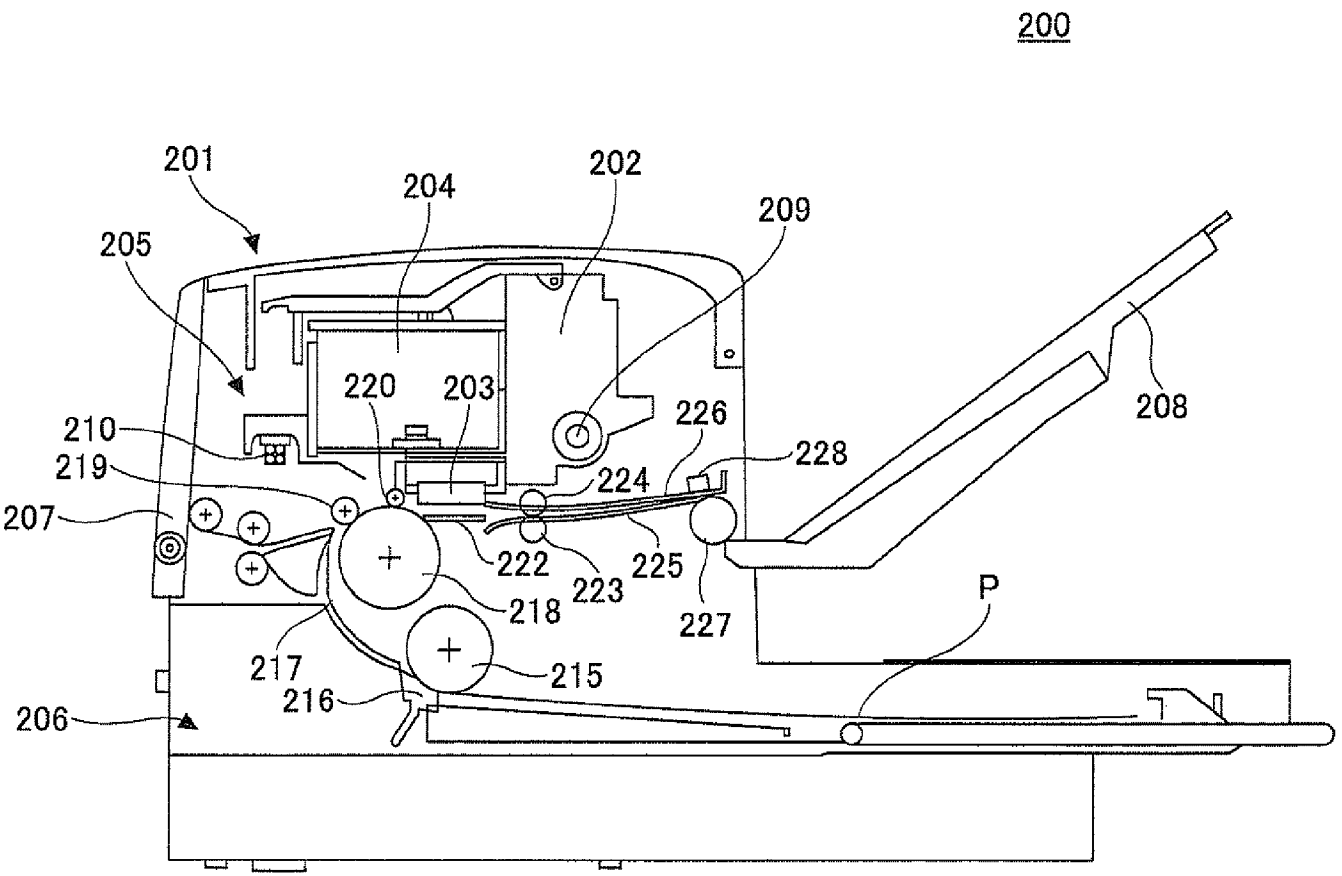

FIGS. 2A and 2B illustrate an example of an ink-jet recording apparatus according to an embodiment. Note that FIGS. 2A and 2B respectively illustrate a perspective view of the ink-jet recording apparatus and a side view of a mechanical component of the ink-jet recording apparatus.

The ink-jet recording apparatus 200 includes a main body 201 that accommodates a printing mechanical unit 205 composed of a carriage 202 movable in a main scanning direction, ink-jet heads 203 mounted on the carriage 202 and ink cartridges 204. The ink-jet recording apparatus 200 further includes a removable paper-feeding cassette 206 arranged at a lower part of the main body 201 and a manual bypass tray 207 above the removable paper-feeding cassette 206. In the removable paper-feeding cassette 206, sheets of paper P may be inserted from its front side and stacked on the removable paper-feeding cassette 206, and the manual bypass tray 207 may be pulled down such that the sheets of paper P may be manually placed on the manual bypass tray 207. The ink-jet recording apparatus 200 catches a sheet of paper P fed from the removable paper-feeding cassette 206 or the manual bypass tray 207, allows the printing mechanical unit 205 to print or record a desired image on the sheet of paper P, and discharges the printed or recorded sheet of paper P onto a catch tray 208 attached to a rear side of the ink-jet apparatus 200.

The carriage 202 is slidably held by a main-guide rod 209 and sub-guide rod 210 bridged across not illustrated left and right side panels of the ink-jet recording apparatus 200. The carriage 202 includes the ink-jet heads 203 having plural nozzles configured to discharge color ink of yellow (Y), cyan (C), magenta (M), and black (Bk). The nozzles are aligned in a direction perpendicular to a main-scanning direction and ink-discharging directions of the nozzles which are downwardly directed. The carriage 202 includes replaceable ink cartridges 204 for supplying respective colors of ink to the ink-jet heads 203.

The ink cartridges 204 include not illustrated air-inlet ports in their upper surfaces in communication with the atmosphere, not illustrated ink-supply ports for supplying ink to the ink-jet heads 203 in their lower surfaces and not illustrated porous bodies filled with ink. The ink to be supplied to the ink-jet heads 203 contained in the porous bodies is maintained with slightly negative pressure by capillary force of the porous bodies.

Note that one ink-jet head configured to discharge colors of ink may be provided in place of the plural ink-jet heads 203 each configured to discharge corresponding colors of ink.

Note that a downstream side in a paper P transferring direction of the carriage 202 is slidably fitted in the main-guide rod 209 whereas an upstream side in the paper P transferring direction of the carriage 202 is slidably placed on the sub-guide rod 209. Further, a timing belt 214 is bridged between a driving pulley 212 and a driven pulley 213 that are rotationally driven by a main-scanning motor 211, and the timing belt 214 is fixed to the carriage 202. With this configuration, the carriage 202 is moved while scanning in the main scanning direction by rotating the main-scanning motor 211.

The main body 201 of the ink-jet recording apparatus 200 further includes a feeding roller 215 configured to separate and feed one of the sheets of paper P from the removable paper-feeding cassette 206, a friction pad 216, a guide member 217 configured to guide the sheet of paper P, a transfer roller 218 configured to reverse the sheet fed from the removable paper-feeding cassette 206 and transfer the reversed sheet, a transfer roller member 219 pressed against a circumferential surface of the transfer roller 218 and a front-end roller member 220 configured to regulate an angle of the feeding sheet transferred from the transfer roller 218. The transfer roller 218 is rotationally driven by a sub-scanning motor 221 via a not illustrated gear array.

The main body 201 of the ink-jet recording apparatus 200 further includes a guide member 222 configured to guide the sheet of paper P transferred from the transfer roller 218 at a lower side of the ink-jet heads 203 corresponding to a moving range in the main-scanning direction of the carriage 202. The main body 201 of the ink-jet recording apparatus 200 further includes a rotationally driven transfer roller member 223 and a spur 224 at a downstream side of the guide member 222 in the paper P transferring direction so as to discharge the sheet of paper in the paper P discharge direction. The main body 201 of the ink-jet recording apparatus 200 further includes guide members 225 and 226 configured to guide the sheet of paper P transferred from the transfer roller member 223 and the spur 224 and a discharge roller 227 and a spur 228 configured to discharge the sheet transferred from the guide members 225 and 226 onto the catch tray 208.

For recording an image on the sheet of paper P, the following operation is repeatedly carried out. In the repeating operation, a line of the image is recorded by discharging ink onto the stationary sheet of paper P by driving the ink-jet heads 203 based on an image signal while moving the carriage 202, and the recorded sheet of paper P is then transferred such that another line of the image is ready to be recorded. When receiving a signal indicating that the recording of the image is finished or a signal indicating that a rear end of the sheet of paper P has reached a recording region, the image recording operation is terminated and the recorded sheet of paper P is discharged.

The main body 201 of the ink-jet recording apparatus 200 further includes a restoration device 229 configured to recover the malfunctioned ink-jet heads 203 exhibiting a defective discharge operation located away from the recording region at a right end side in the carriage 202 moving direction. The restoration device 229 includes a capping unit (not illustrated), a suction unit (not illustrated) and a cleaning unit (not illustrated). When the carriage 202 in a standby mode moves to the restoration device 229 side, the capping unit places caps on the ink-jet heads 203 to maintain moisture of the nozzles of the ink-jet heads 203. Accordingly, ink in the nozzles is prevented from being dried. Further, all the nozzles of the ink-jet heads 203 may maintain uniform viscosity of the ink by discharging the ink not used for recording the image from the nozzles so as to maintain stable discharging performance of the ink-jet heads 203.

Note that if the defective discharge operation has occurred, the capping unit tightly shields the nozzles of the ink-jet heads 203, the suction unit suctions the ink and air bubbles via a tube and the cleaning unit removes the ink and dust attached to the nozzles. As a result, the defective discharge operation of the ink-jet heads 203 may be restored. In this process, the ink suctioned by the suction unit is discharged into an ink drainage reservoir (not illustrated) provided at a lower part of the main body 201 and the discharged ink is absorbed by an ink absorber arranged inside the ink drainage reservoir and the absorbed ink is maintained by the ink absorber.

EXAMPLES

Synthesis of PZT Precursor Solution

After having dissolved lead acetate trihydrate in methoxyethanol, the obtained product of the lead acetate trihydrate dissolved in methoxyethanol is then dewatered, thereby preparing a methoxyethanol solution of lead acetate trihydrate. Meanwhile, after having dissolved titanium isopropoxide and zirconium isopropoxide in methoxyethanol, alcohol exchange reactions and esterification reactions are accerelated. Subsequently, the methoxyethanol solution of lead acetate trihydrate is added to the above product, thereby preparing 0.5 mol/L of a PZT precursor solution. In this process, the amount of the methoxyethanol solution of lead acetate trihydrate added above includes an extra 10 mol % of lead based on the stoichiometry in order to prevent crystallinity from being lowered due to deleading during heat processing.

Example 1

A thermally-oxidized film with a film thickness of 1 μm was formed as a vibrating plate on a silicon wafer having a (1 0 0) surface as a main surface. Thereafter, a titanium film with a film thickness of 50 nm, platinum with a film thickness of 200 nm, and a SrRuO film with a film thickness of 100 nm were deposited by sputtering on the thermally-oxidized film formed on the silicon wafer.

Subsequently, a process of coating the obtained layered product with the PZT precursor solution, drying the PZT precursor solution coated layered product at 120° C., and pyrolytically decomposing the dried layered product at 500°

C. was repeatedly carried out three times. There were no defects such as cracks observed in the obtained film. The obtained film was subject to rapid thermal annealing (RTA) at 700° C. to be thermally crystallized. The RTA was repeatedly carried out four times, thereby forming a $Pb(Zr_{0.53}Ti_{0.47})O_3$ film having a film thickness of 1 μm.

Next, a layered product of a SrRuO film with a film thickness of 100 nm and a platinum film with a thickness of 100 nm was deposited on the $Pb(Zr_{0.53}Ti_{0.47})O_3$ film by sputtering.

Subsequently, photoresist TSMR-8800 (Tokyo Ohka Kogyo Co., Ltd.) was applied to the layered product by spin-coating, a resist pattern was formed by photolithography, and patterning was then carried out by an ICP etching apparatus (manufactured by Samco Inc.). As a result, the piezoelectric element 120 was produced (see FIGS. 1A and 1B).

Subsequently, an $Al_2O_3$ film (i.e., the first insulator film 131) having a film thickness of 50 nm was formed by the ALD process on the vibrating plate 112*a* on which the piezoelectric element 120 was formed. In this process, trimethylamine (TMA) (Sigma-Aldrich Co. LLC.) and $O_3$ generated by an ozone generator were alternately deposited as raw materials of Al and O.

Subsequently, a ZrO film (i.e., the second insulator film 132) having a film thickness of 150 nm was deposited on the first insulator film 131 by the ALD process. In this process, $Zr(t\text{-}OC_4H_9)_4$ (Sigma-Aldrich Co. LLC.) and $O_3$ generated by the ozone generator were alternately deposited as raw materials of Zr and O.

Subsequently, a contact hole part was formed by etching in each of the first insulator film 131 and the second insulator film 132. Then, Al was sputtered on the second insulator film 132 and the sputtered Al was patterned by etching, thereby forming the individual electrode wires 140 and 150.

Subsequently, a SiN film having a film thickness of 1 μm was deposited on the individual electrode wires 140 and 150 by the p-CVD process. Thereafter, contact holes were formed by etching, thereby forming the third insulator film 133. Further, the third insulator film 133 was etched such that the third insulator film 133 was removed from a region excluding a region including the individual electrode wire 140 formed above the space partitioned by the later formed division walls 112*b*. The film thickness in a region (i.e., the second region) of the second insulator layer 132, on which the third insulator film 133 was not formed, was 24 nm due to overetching while etching the second insulator film 132.

Thereafter, an opening was formed as a pad part from which the individual electrode wire or the common electrode wire was drawn.

Example 2

The ink-jet head was produced in the same manner as Example 1, except that the film thickness of the ZrO film (i.e., the second insulator film 132) was changed to 100 nm. The film thickness in the region (i.e., the second region) of the second insulator layer 132 on which the third insulator film 133 was not formed was 9 nm.

Example 3

The ink-jet head was produced in the same manner as Example 1, except that the film thickness of the $Al_2O_3$ film (i.e., the first insulator film 131) was changed to 20 nm. The film thickness in the region (i.e., the second region) of the second insulator layer 132 on which the third insulator film 133 was not formed was 25 nm.

Example 4

The ink-jet head was produced in the same manner as Example 1, except that the film thickness of the ZrO film (i.e., the second insulator film 132) was changed to 300 nm. The film thickness in the region (i.e., the second region) of the second insulator layer 132 on which the third insulator film 133 was not formed was 35 nm.

Example 5

The ink-jet head was produced in the same manner as Example 1, except that the $SiO_2$ film (i.e., the second insulator film 132) was deposited with a film thickness of 500 nm by the p-CVD. The film thickness in the region (i.e., the second region) of the second insulator layer 132 on which the third insulator film 133 was not formed was 38 nm.

Comparative Example 1

The ink-jet head was produced in the same manner as Example 1, except that the film thickness of the ZrO film (i.e., the second insulator film 132) was changed to 50 nm. The film thickness in the region (i.e., the second region) of the second insulator layer 132 on which the third insulator film 133 was not formed was 6 nm.

Comparative Example 2

The ink-jet head was produced in the same manner as Example 1, except that the film thickness of the $Al_2O_3$ film (i.e., the first insulator film 131) was changed to 10 nm. The film thickness in the region (i.e., the second region) of the second insulator layer 132 on which the third insulator film 133 was not formed was 2 nm.

[Electric Property]

The electric properties of the ink-jet heads produced in the examples and the comparative examples were evaluated. The electric property of each of the ink-jet head was evaluated after allowing the ink-jet head to stand for 100 hours under the environment of an air temperature of 80° C. and a relative humidity of 85%. Note that the electric property of each of the ink-jet heads was evaluated by measuring saturation polarization Ps ($\mu C/cm^2$) under field intensity of 150 kV/cm utilizing a ferrodielectric property evaluation system FCE-1 (manufactured by TOYO Corporation).

Prior to evaluating the electric property, formation of a short circuit between the lower electrode and the upper electrode when the voltage within the above range was applied was examined.

In addition, each of the ink-jet heads 100 was formed by etching the silicon wafer, forming the division walls 112*b*, and bonding the nozzle plate 111 having preformed nozzle pores 111*a* with the division walls 112*b*, and liquid droplet discharge performance of each of the ink-jet heads 100 was evaluated. The liquid droplet discharge condition of the ink-jet head 100 was examined by applying a voltage range of −10 to −30 V with a simple push waveform utilizing ink having viscosity adjusted to 5 cp. TABLE 1 illustrates results of the short circuit test, electric property test and discharge performance test.

TABLE 1

| | FILM THICKNESS OF SECOND INSULATOR FILM (nm) | | | ELECTRIC PROPERTY PS (μm/cm²) | | |
|---|---|---|---|---|---|---|
| | *1ST REGION | **2ND REGION | SHORT-CIRCUIT TEST | INITIAL STAGE | AFTER CERTAIN TIME | DISCHARGE TEST |
| EXAMPLE 1 | 150 | 24 | PASS | 47 | 47 | PASS |
| EXAMPLE 2 | 100 | 9 | PASS | 48 | 48 | PASS |
| EXAMPLE 3 | 150 | 25 | PASS | 46 | 45 | PASS |
| EXAMPLE 4 | 300 | 35 | PASS | 46 | 45 | PASS |
| EXAMPLE 5 | 500 | 38 | PASS | 46 | 45 | PASS |
| COMPARATIVE EXAMPLE 1 | 50 | 6 | FAIL | NA | NA | NA |
| COMPARATIVE EXAMPLE 2 | 150 | 2 | PASS | 32 | 17 | FAIL |

*1ST region: A region of the second insulator film where the third insulator film is formed
2ND region: A region of the second insulator film where the third insulator film is NOT formed As illustrated in TABLE 1, the results indicate that the short circuit was formed between the electrodes due to insufficient film thickness of the second insulator film 132 in Comparative Example 1. Further, in Comparative Example 2, an inferior electric property was obtained as a result of process damage caused while forming the third insulator film 133, due to the insufficient thickness in the region of the second insulator film 132 on which the third insulator film 133** was not formed.

In contrast, the ink-jet heads produced in the Examples all exhibited excellent liquid droplet discharge performance and capability in inhibiting the deterioration of the piezoelectric element caused by the moisture in the atmosphere.

The ink-jet head according to the aforementioned embodiment is capable of reducing its size and densifying its components while inhibiting the piezoelectric element from being deteriorated due to the moisture in the atmosphere.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2011-036348 filed on Feb. 22, 2011, the entire contents of which are hereby incorporated herein by reference.

What is claimed is:

1. An ink-jet head comprising:

a nozzle plate having a plurality of nozzles;

a vibrating plate arranged on the nozzle plate;

a plurality of liquid chambers formed of spaces between the vibrating plate and the nozzle plate, the spaces being partitioned by division walls;

a piezoelectric element composed of a common electrode, a piezoelectric body and an individual electrode layered in this order, the piezoelectric element being formed on a first surface of the vibrating plate opposite to a second surface thereof that forms the liquid chambers;

a first insulator film having a first opening and a second insulator film having a second opening, the first insulator film and the second insulator film being layered in this order on the first surface having the piezoelectric element of the vibrating plate;

a first wire drawn from the individual electrode via the first opening of the first insulator film and the second opening of the second insulator film;

a third insulator film having a third opening, the third insulator film being formed on the first wire; and a second wire configured to electrically couple the first wire and a driving circuit, the second wire being drawn via the third opening of the third insulator film, wherein the third insulator film is formed in a first region of the second insulator film and is not formed in a second region thereof, the second region excluding a region including the first wire formed above the liquid chamber, and the first region of the second insulator film includes a film thickness of 100 nm or more, and the second region of the second insulator film includes a film thickness range of 5 to 40 nm, and wherein both of the first insulator film and the second insulator film are interposed throughout between the piezoelectric element and the first wire, except for portions occupied by the first opening and the second opening.

2. The ink-jet head as claimed in claim 1, wherein the third insulator film is patterned by etching, and the second insulator film serves as a protection layer for the first insulator film while the etching is performed.

3. The ink-jet head as claimed in claim 2, wherein the second insulator film is formed of one or more kinds of materials selected from a group including ZrO, TiO, TaO and SiO, the second insulator film being formed by an ALD process, or the second insulator film is formed of any one of SiO and SiN, the second insulator film being formed by a p-CVD process.

4. The ink-jet head as claimed in claim 1, wherein the first insulator film includes a film thickness range of 20 to 100 nm.

5. The ink-jet head as claimed in claim 1, wherein the first insulator film is formed by an ALD process.

6. An ink-jet recording apparatus comprising;

the ink-jet head as claimed in claim 1; and an ink storing unit that stores ink to be supplied to the ink-jet head.

7. The ink-jet head as claimed in claim 1, wherein the first insulator film and the second insulator film are disposed side-by-side, to interpose between the piezoelectric element and the first wire.

* * * * *